US009859615B2

(12) United States Patent
Ko

(10) Patent No.: US 9,859,615 B2
(45) Date of Patent: Jan. 2, 2018

(54) DUAL-BAND ANTENNA

(71) Applicant: Sercomm Corporation, Taipei (TW)

(72) Inventor: Cheng-Hung Ko, Taipei (TW)

(73) Assignee: Sercomm Corporation, Taipei (TW)

( * ) Notice: Subject to any disclaimer, the term of this patent is extended or adjusted under 35 U.S.C. 154(b) by 0 days.

(21) Appl. No.: 15/291,078

(22) Filed: Oct. 12, 2016

(65) Prior Publication Data

US 2017/0201022 A1 Jul. 13, 2017

(30) Foreign Application Priority Data

Jan. 12, 2016 (CN) ..... 2016 2 0025806 U

(51) Int. Cl.

| | |
|---|---|
| ***H01Q 5/00*** | (2015.01) |
| ***H01Q 5/30*** | (2015.01) |
| ***H01Q 1/48*** | (2006.01) |
| ***H01Q 9/04*** | (2006.01) |

(52) U.S. Cl.

CPC ..... *H01Q 5/30* (2015.01); *H01Q 1/48* (2013.01); *H01Q 9/0421* (2013.01)

(58) Field of Classification Search

None

See application file for complete search history.

(56) References Cited

U.S. PATENT DOCUMENTS

| | | | | |
|---|---|---|---|---|
| 6,166,694 | A * | 12/2000 | Ying | H01Q 1/243 343/700 MS |
| 6,836,248 | B2 * | 12/2004 | Fukushima | H01Q 1/242 343/700 MS |
| 7,782,257 | B2 * | 8/2010 | Kim | H01Q 7/00 343/700 MS |
| 2007/0132641 | A1 * | 6/2007 | Korva | H01Q 1/243 343/700 MS |
| 2008/0266180 | A1 * | 10/2008 | Wu | H01Q 1/243 343/700 MS |
| 2009/0224987 | A1 * | 9/2009 | Maddaleno | H01Q 1/243 343/702 |
| 2011/0043408 | A1 * | 2/2011 | Shi | H01Q 1/48 343/700 MS |
| 2013/0201074 | A1 * | 8/2013 | Harper | H01Q 1/243 343/870 |
| 2014/0197996 | A1 * | 7/2014 | Yonei | H01Q 9/0421 343/700 MS |

* cited by examiner

*Primary Examiner* — Trinh Dinh
(74) *Attorney, Agent, or Firm* — JCIPRNET

(57) ABSTRACT

A dual-band antenna including a ground element, a short-circuit element, a feed element and a radiator is provided. The radiator includes a first connection segment, a first radiation element, a second radiation element, a third radiation element and a fourth radiation element. The dual-band antenna covers a first frequency band a second frequency band through the symmetrical first radiation element and second radiation element and the symmetrical third radiation element and fourth radiation element, so as to effectively decrease an antenna volume, and satisfy the requirement of a signal coverage range of a communication device.

10 Claims, 2 Drawing Sheets

DUAL-BAND ANTENNA

CROSS-REFERENCE TO RELATED APPLICATION

This application claims the priority benefit of Chinese application serial no. 201620025806.0, filed on Jan. 12, 2016. The entirety of the above-mentioned patent application is hereby incorporated by reference herein and made a part of this specification.

BACKGROUND OF THE INVENTION

Field of the Invention

The invention relates to an antenna, and particularly relates to a dual-band antenna.

Description of Related Art

Regarding a ceiling type communication device, a requirement on an antenna thereof is that a depression angle of a field pattern should be small enough in order to achieve sufficient signal coverage range. Generally, if the antenna is designed in a way of external antenna, a dipole antenna can be adopted to achieve a best coverage range. However, since a requirement of today's product design has a trend of small volume and simple shape, the antenna is required to be designed in a way of built-in antenna, and the dipole antenna generally has a too large size, which is not suitable for being disposed in internal of the device.

SUMMARY

The invention is directed to a dual-band antenna, which is adapted to provide a communication device with a sufficient signal coverage range, and is adapted to be built in internal of the communication device due to its small volume.

The invention provides a dual-band antenna including a ground element, a short-circuit element, a feed element and a radiator. A first end of the short-circuit element is connected to the ground element. A first end of the feed element has a feed point. The radiator includes a first connection segment, a first radiation element, a second radiation element, a third radiation element and a fourth radiation element. Second ends of the short-circuit element and the feed element are connected to the first connection segment, and the short-circuit element and the feed element are disposed at two opposite sides of the first connection segment along an extending direction of a symmetric axis of the first connection segment. The second radiation element is symmetrical to the first radiation element relative to the symmetric axis of the first connection segment, first ends of the first radiation element and the second radiation element are connected to the first connection segment, and second ends of the first radiation element and the second radiation element are open ends. The fourth radiation element is symmetrical to the third radiation element relative to the symmetric axis, first ends of the third radiation element and the fourth radiation element are connected to the first connection segment, second ends of the third radiation element and the fourth radiation element are open ends, and the second ends of the third radiation element and the fourth radiation element are respectively opposite to the second ends of the first radiation element and the second radiation element.

According to the above description, in the embodiment of the invention, by using the symmetrical first radiation element and second radiation element and the symmetrical third radiation element and the fourth radiation element, the dual-band antenna covers a first frequency band and a second frequency band, and such structure of the dual-band antenna may effectively reduce an antenna volume, such that the dual-band antenna is adapted to be built in internal of the communication device, and satisfies a requirement on the signal coverage range of the communication device.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
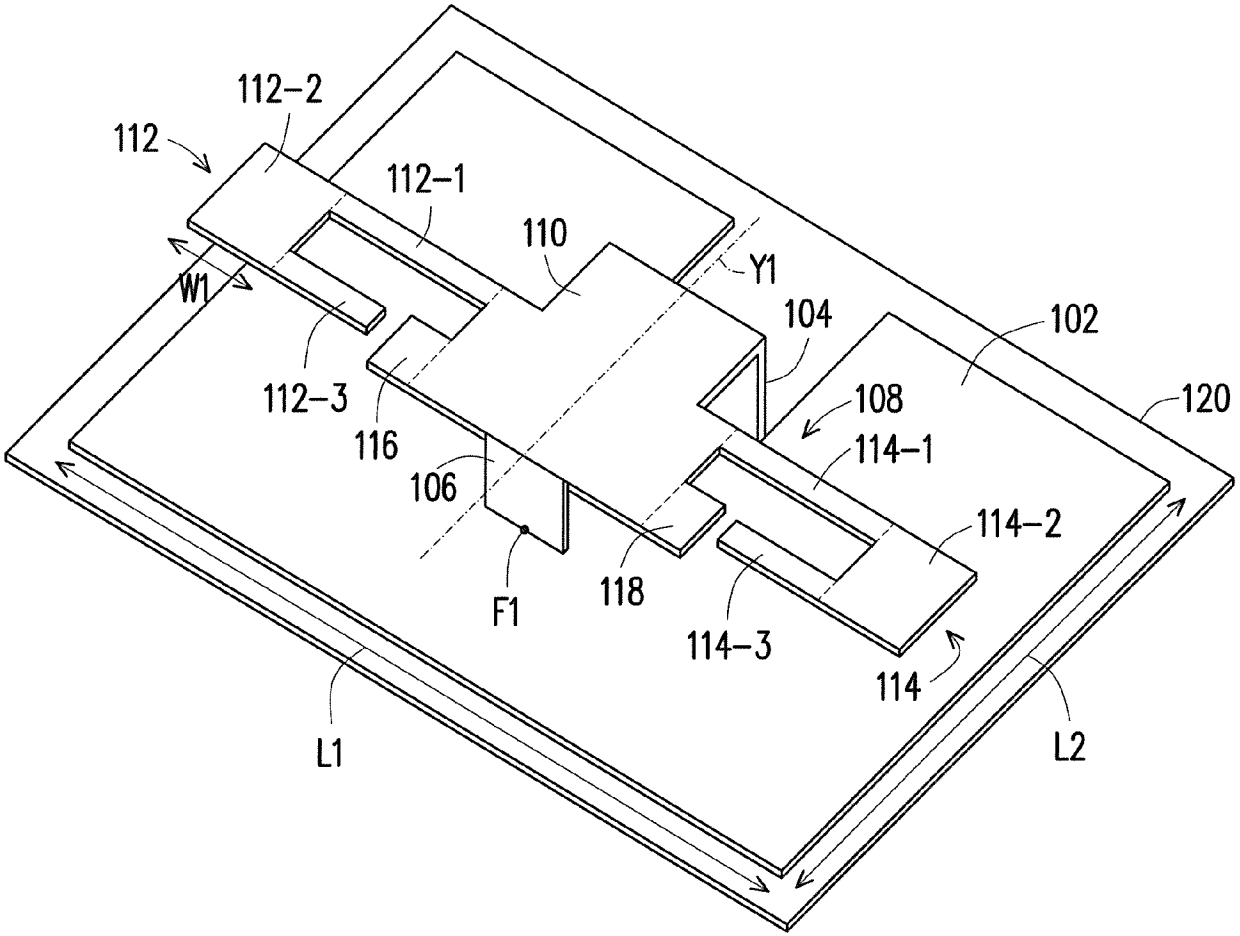
FIG. 1 is a schematic diagram of a dual-band antenna according to an embodiment of the invention.

FIG. 1 is a schematic diagram of a dual-band antenna according to an embodiment of the invention. The dual-band antenna is an inverted-F antenna, which can be applied to a communication device, and the communication device is, for example, wireless access point (AP), though the invention is not limited thereto. The dual-band antenna may include a ground element 102, a short-circuit element 104, a feed element 106 and a radiator 108, where the radiator 108 is parallel to the ground element 102, and the radiator 108 includes a first connection segment 110, a first radiation element 112, a second radiation element 114, a third radiation element 116 and a fourth radiation element 118. A first end of the short-circuit element 104 is connected to the ground element 102, and another end of the short-circuit element 104 is connected to the first connection segment 110. A first end of the feed element 106 has a feed point F1 configured for receiving a feed signal, and a second end of the feed element 106 is connected to the first connection segment 110. The short-circuit element 104 and the feed element 106 are disposed at two opposite sides of the first connection segment 110 along an extending direction of a symmetric axis Y1 of the first connection segment 110. The first radiation element 112 is symmetrical to the second radiation element 114 relative to the symmetric axis Y1 of the first connection segment 110. First ends of the first radiation element 112 and the second radiation element 114 are connected to the first connection segment 110, and second ends of the first radiation element 112 and the second radiation element 114 are open ends. Moreover, the third radiation element 116 is symmetrical to the fourth radiation element 118 relative to the symmetric axis Y1, and first ends of the third radiation element 116 and the fourth radiation element 118 are connected to the first connection segment 110, and second ends of the third radiation element 116 and the fourth radiation element 118 are open ends. The second ends of the third radiation element 116 and the fourth radiation element 118 are respectively opposite to the second ends of the first radiation element 112 and the second radiation element 114.

The ground element 102 is disposed above a circuit board 120 (which is, for example, a printed circuit board) of the communication device applying the dual-band antenna. The feed element 106 may receive a feed signal from the feed point F1, and under excitation of the feed signal, the feed element 106, the first connection segment 110 and the short-circuit element 104 may form a current loop. In addition, the dual-band antenna may have a resonant mode through resonant paths from the feed point F1 to the open end of the first radiation element 112 and from the feed point F1 to the open end of the second radiation element 114, such that the dual-band antenna covers a first frequency band. Meanwhile, the dual-band antenna may further have another resonant mode through resonant paths from the feed point F1 to the open end of the third radiation element 116, from the feed point F1 to the open end of the fourth radiation element 118, and from the feed point F1 to the first end of the short-circuit element 104, such that the dual-band antenna covers a second frequency band. The ground element 102 has a long side L1 and a short side L2, and a sum of lengths of the long side L1 and the short side L2 is greater than or equal to an integral multiple of ¼ wavelengths of electromagnetic waves irradiated by the first radiation element 112 and the second radiation element 114.

In this way, the frequency bands required by the wireless AP are satisfied, which greatly increases a performance of the wireless communications. For example, to transmit-receive signals of a Wireless Fidelity (WiFi) standard, where the first frequency band is, for example, between 2400 MHz and 2500 MHz, and the second frequency band is, for example, between 5150 MHz and 5850 MHz. The structure of the dual-band antenna may effectively reduce a volume of the antenna. In the embodiment of the invention, a distance between the radiator 108 and the ground element 102 can be as low as 8.3 mm, and the long side L1 and the short side L2 of the ground element 102 can be as short as 46 mm and 31.6 mm, such that the dual-band antenna is easy to be built in internal of the communication device, and satisfy the requirement on signal coverage range of the communication device.

Figure 2:
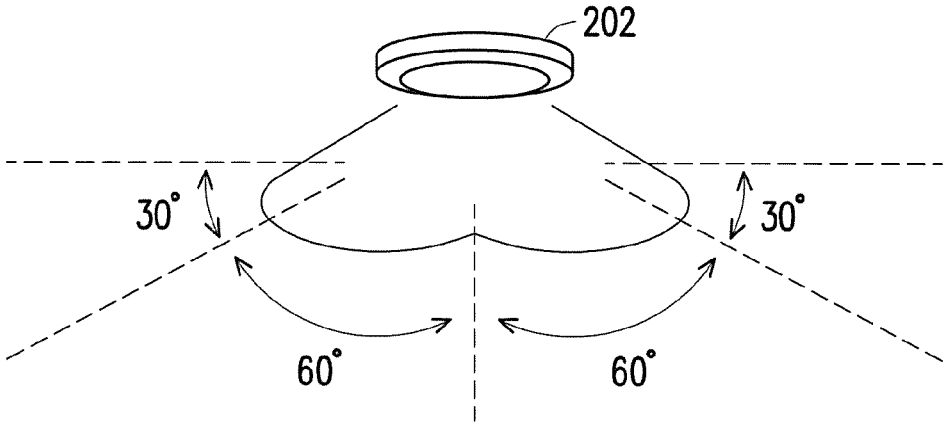
FIG. 2 is a schematic diagram of a ceiling type communication device applying the dual-band antenna according to an embodiment of the invention.

Moreover, by disposing the ground element 102 above the circuit board 102 (i.e. the ground element 102 is disposed between the radiator 108 and the circuit board 120), a depression angle of the dual-band antenna may be reduced to an angle required by the communication device through energy reflection of the circuit board 120, so as to further satisfy the requirement on signal coverage range of the communication device. FIG. 2 is a schematic diagram of a ceiling type communication device applying the dual-band antenna according to an embodiment of the invention. Referring to FIG. 2, the dual-band antenna (not shown in FIG. 2) can be built in the ceiling type communication device 202 (which is, for example, a wireless AP), and through the energy reflection of the circuit board 120 (not shown in FIG. 2, which is, for example, a printed circuit board) in the ceiling type communication device 202, a radiation direction of the radiation field pattern of the dual-band antenna may have a depression angle of 30 degrees, so as to further satisfy the requirement on signal coverage range of the ceiling type communication device 202.

It should be noted that ranges of the first frequency band and the second frequency band are only examples, and the invention is not limited to the aforementioned frequency bands. In other embodiments, the first radiation element 112, the second radiation element 114, the third radiation element 116 and the fourth radiation element 118 can be fine tuned to change a distribution of the first frequency band and the second frequency band. For example, the first radiation element 112 of FIG. 1 may include a second connection segment 112-1, a third connection segment 112-2 and a fourth connection segment 112-3, where a first end of the second connection segment 112-1 is connected to the first connection segment 110, a second end of the second connection segment 112-1 and a first end of the fourth connection segment 112-3 are connected to a same side of the third connection segment 112-2, and a second end of the fourth connection segment 112-3 is an open end. A width W1 of the third connection segment 112-2 is associated with a center frequency of the first frequency band. For example, by decreasing the width W1 of the third connection segment 112-2, the resonant path provided by the first radiation element 112 can be shortened to increase the center frequency of the first frequency band. Similarly, the second radiation element 114 may also include a second connection segment 114-1, a third connection segment 114-2 and a fourth connection segment 114-3, and since the first radiation element 112 and the second radiation element 114 are symmetrical elements, the structure and adjusting method of the second radiation element 114 are not repeated.

Moreover, a distance between the second end of the first radiation element 112 and the second end of the third radiation element 116 and a distance between the second end of the second radiation element 114 and the second end of the fourth radiation element 118 are associated with a bandwidth of the second frequency band. For example, by decreasing or increasing the lengths of the third radiation element 116 and the fourth radiation element 118 to adjust the distance between the second end of the first radiation element 112 and the second end of the third radiation element 116 and the distance between the second end of the second radiation element 114 and the second end of the fourth radiation element 118, the bandwidth of the second frequency band can be adjusted. Moreover, the dual-band antenna can be formed by a conductive metal sheet through integral stamping. Compared to the antenna of the prior art that is produced through welding, besides that the manufacturing cost is decreased, the production quality of the dual-band antenna is also more stable.

In summary, by using the symmetrical first radiation element and second radiation element and the symmetrical third radiation element and the fourth radiation element, the dual-band antenna of the invention covers the first frequency band and the second frequency band. Such structure of the dual-band antenna may effectively reduce an antenna volume, such that the dual-band antenna is adapted to be built in internal of the communication device, and the communication device applying the dual-band antenna may have advantages of small volume and simple shape, so as to cope with a trend of today's product design and satisfy a requirement on the signal coverage range of the communication device. Moreover, by disposing the ground element above the circuit board (i.e. the ground element is disposed between the radiator and the circuit board), a depression angle of the dual-band antenna may be reduced to an angle required by the communication device through energy reflection of the circuit board, so as to further satisfy the requirement on signal coverage range of the communication device. Moreover, regarding the structure of the dual-band antenna, the dual-band antenna can be formed by a conductive metal sheet through integral stamping, by which besides that the manufacturing cost is decreased, the production quality of the dual-band antenna is also stable.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A dual-band antenna, comprising:

a ground element;

a short-circuit element, having a first end connected to the ground element;

a feed element, having a first end comprising a feed point; and a radiator, comprising:

a first connection segment, wherein second ends of the short-circuit element and the feed element are connected to the first connection segment, and the short-circuit element and the feed element are disposed at two opposite sides of the first connection segment along an extending direction of a symmetric axis of the first connection segment;

a first radiation element;

a second radiation element, symmetrical to the first radiation element relative to the symmetric axis of the first connection segment, wherein first ends of the first radiation element and the second radiation element are connected to the first connection segment, and second ends of the first radiation element and the second radiation element are open ends;

a third radiation element; and a fourth radiation element, symmetrical to the third radiation element relative to the symmetric axis, wherein first ends of the third radiation element and the fourth radiation element are connected to the first connection segment, second ends of the third radiation element and the fourth radiation element are open ends, and the second ends of the third radiation element and the fourth radiation element are respectively opposite to the second ends of the first radiation element and the second radiation element.

2. The dual-band antenna as claimed in claim 1, wherein the radiator is parallel to the ground element.

3. The dual-band antenna as claimed in claim 1, wherein the ground element has a long side and a short side, and a sum of lengths of the long side and the short side is greater than or equal to an integral multiple of ¼ wavelengths of electromagnetic waves irradiated by the first radiation element and the second radiation element.

4. The dual-band antenna as claimed in claim 1, wherein the first radiation element and the second radiation element respectively comprise:

a second connection segment, having a first end connected to the first connection segment;

a third connection segment, connected to a second end of the second connection segment; and a fourth connection segment, having a first end connected to the third connection segment, and a second end of the fourth connection segment being an open end.

5. The dual-band antenna as claimed in claim 4, wherein the first connection segment, the first radiation element and the second radiation element enable the dual-band antenna to cover a first frequency band, and a width of the third connection segment is associated with a center frequency of the first frequency band.

6. The dual-band antenna as claimed in claim 5, wherein the first frequency band is between 2400 MHz and 2500 MHz.

7. The dual-band antenna as claimed in claim 1, wherein the first connection segment, the third radiation element and the fourth radiation element enable the dual-band antenna to cover a second frequency band, and a distance between the second end of the third radiation element and the second end of the first radiation element and a distance between the second end of the fourth radiation element and the second end of the second radiation element are associated with a bandwidth of the second frequency band.

8. The dual-band antenna as claimed in claim 7, wherein the second frequency band is between 5150 MHz and 5850 MHz.

9. The dual-band antenna as claimed in claim 1, wherein the dual-band antenna is formed by a conductive metal sheet through integral stamping.

10. The dual-band antenna as claimed in claim 1, wherein the dual-band antenna is an inverted-F antenna.

* * * * *